US005702238A

United States Patent [19]

Simmons et al.

[11] Patent Number: 5,702,238

[45] Date of Patent: Dec. 30, 1997

[54] DIRECT DRIVE GAS COMPRESSOR WITH VENTED DISTANCE PIECE

[75] Inventors: Daniel Cecil Simmons, Box 402, Pouce Coupe, B.C., Canada, V0C 2C0; Walter James Forsyth, 9021 Elwood Drive, Dawson Creek, B.C., Canada, V1G 3M8; Reggald Emory Isley, Grande Prairie, Canada

[73] Assignees: Daniel Cecil Simmons, Pouce Coupe; Walter James Forsyth, Dawson Creek, both of Canada

[21] Appl. No.: 595,880

[22] Filed: Feb. 6, 1996

[51] Int. Cl.[6] ..... F04B 17/05

[52] U.S. Cl. ..... 417/380; 92/157

[58] Field of Search ..... 417/380, 399, 417/401, 372; 92/157

[56] References Cited

U.S. PATENT DOCUMENTS

| | | | |
|---|---|---|---|
| 1,001,132 | 8/1911 | Frey . | |
| 1,397,914 | 11/1921 | Augustin et al. | 417/535 |
| 1,694,583 | 12/1928 | Conklin . | |
| 1,993,230 | 3/1935 | Taylor . | |
| 2,628,015 | 2/1953 | Neugebauer et al. . | |
| 3,172,369 | 3/1965 | Ballu | 417/537 |
| 3,986,796 | 10/1976 | Moiroux et al. . | |
| 3,995,974 | 12/1976 | Herron . | |
| 4,096,692 | 6/1978 | Nakamura et al. . | |
| 4,097,198 | 6/1978 | Herron . | |
| 4,115,037 | 9/1978 | Butler | 417/380 |
| 4,480,968 | 11/1984 | Duerr | 417/380 |
| 4,915,598 | 4/1990 | Kubis . | |
| 4,952,123 | 8/1990 | Gebhardt . | |
| 5,114,321 | 5/1992 | Milburn et al. | 417/467 |
| 5,203,680 | 4/1993 | Waldrop . | |
| 5,261,797 | 11/1993 | Christenson | 417/380 |
| 5,332,368 | 7/1994 | Macier et al. . | |
| 5,464,331 | 11/1995 | Sawyer . | |

FOREIGN PATENT DOCUMENTS

| | | | |
|---|---|---|---|
| 173554 | 12/1921 | United Kingdom . | |
| 685289 | 12/1952 | United Kingdom | 417/380 |
| 1502171 | 2/1978 | United Kingdom . | |

OTHER PUBLICATIONS

Hamworthy compressor Systems Limited "*Horizontal Compressors 6–450 bar*" brochure (date unknown).

*Primary Examiner*—Timothy Thorpe
*Assistant Examiner*—Cheryl J. Tyler
*Attorney, Agent, or Firm*—Oyen, Wiggs, Green & Mutala

[57] ABSTRACT

A reciprocating piston gas compressor driven by an integral internal combustion engine is disclosed. The compressor may be used as an air compressor but has particular application for compressing natural gas from natural gas wells. It has few moving parts. The compressor has a reciprocating assembly, one end of which functions as the piston in an engine and the other end of which functions as the piston in a compressor. Motion of the assembly is regulated by a crankshaft. The crankshaft is connected to the reciprocating assembly by a linkage having arms which pass on either side of the assembly. The crankshaft preferably extends through a slot in the reciprocating assembly. Several compressors may be combined to make a multi-stage compressor.

8 Claims, 6 Drawing Sheets

DIRECT DRIVE GAS COMPRESSOR WITH VENTED DISTANCE PIECE

FIELD OF THE INVENTION

This invention relates to a piston gas compressor driven by an integral internal combustion engine. The compressor has particular application for compressing natural gas from natural gas wells.

BACKGROUND OF THE INVENTION

Natural gas often emerges from gas wells under pressure. This pressure slowly decreases over the life of the well. When the pressure falls to a pressure of about 100–300 PSi it becomes necessary to compress the natural gas from a well to a higher pressure (typically about 300 to 1000 PSi) so that it can be efficiently piped to a collection station. Toward the end of a well's life the gas pressure is typically as low as about 5 to 20 PSi. Gas wells are often in relatively remote locations. Compressors for natural gas produced by such wells are generally driven by internal combustion engines and must have elaborate automatic shut-off systems so that they can safely be left to run unattended for extended periods. Gas compressors are also used in other parts of natural gas distribution systems.

Most current natural gas compressors have the disadvantage that they are complicated and expensive. Many such compressors comprise a standard internal combustion engine. The reciprocating piston in a compressor is driven by way of a linkage connected directly or indirectly to the engine's rotating crankshaft.

Butler, U.S. Pat. No. 4,115,037 discloses a compressor comprising a pair of opposed pistons operating in a cylinder. The pistons are connected to a crankshaft, which is located on one side of the cylinder, by connecting rods. The connecting rods are coupled to transverse crossheads on the pistons which project through slots in the side of the cylinder wall facing the crankshaft. Balancing weights are provided on the opposite ends of the crossheads. A problem with the Buffer compressor is that the connecting rods are offset from the pistons and, therefore, the pistons are subject to torsional forces. The Butler compressor can be subject to undesirable vibration and the parts may be subject to excessive stress and wear.

Some gas compressors have a double acting piston which reciprocates in a cylinder. The piston is driven by a reciprocating piston rod which extends through a packing at one end of the cylinder. A disadvantage of such compressors is that the piston rod packing wears and can require frequent service.

SUMMARY OF THE INVENTION

This invention provides a gas compressor comprising: an engine cylinder having a longitudinal axis; an engine piston slidably and sealingly mounted in the engine cylinder; a compressor cylinder having a longitudinal axis generally parallel to the longitudinal axis of the engine cylinder; a compressor piston slidably and sealingly mounted in the compressor cylinder; a rigid link connecting the engine piston and the compressor piston; a crankshaft having an axis of rotation transverse to the longitudinal axis of the engine cylinder; and, a mechanical linkage connecting the rigid link to the crankshaft. The mechanical linkage comprises a pair of arms pivotally mounted to the rigid link. A first one of the arms extends between the rigid link and the crankshaft on a first side of the rigid link. A second one of the arms extends between the rigid link and the crankshaft on a second side of the rigid link. In a preferred embodiment of the invention the engine cylinder is coaxial with the compressor cylinder.

A second, somewhat more specific, aspect of the invention provides a gas compressor comprising: an engine cylinder having a longitudinal axis; an engine piston slidably and sealingly mounted in the engine cylinder; a compressor cylinder coaxial with the engine cylinder; a compressor piston slidably and sealingly located in the compressor cylinder; a rigid link connecting the engine and compressor pistons; and a crankshaft having a crank extending through a transversely extending aperture in the rigid link. In a preferred embodiment the crank is journalled for rotation in a bearing block. The bearing block is slidably mounted in the transversely extending aperture in the rigid link.

BRIEF DESCRIPTION OF THE DRAWINGS

In the appended drawings which show non-limiting preferred embodiments of the invention.

DETAILED DESCRIPTION OF PREFERRED EMBODIMENTS OF THE INVENTION

Figure 1:
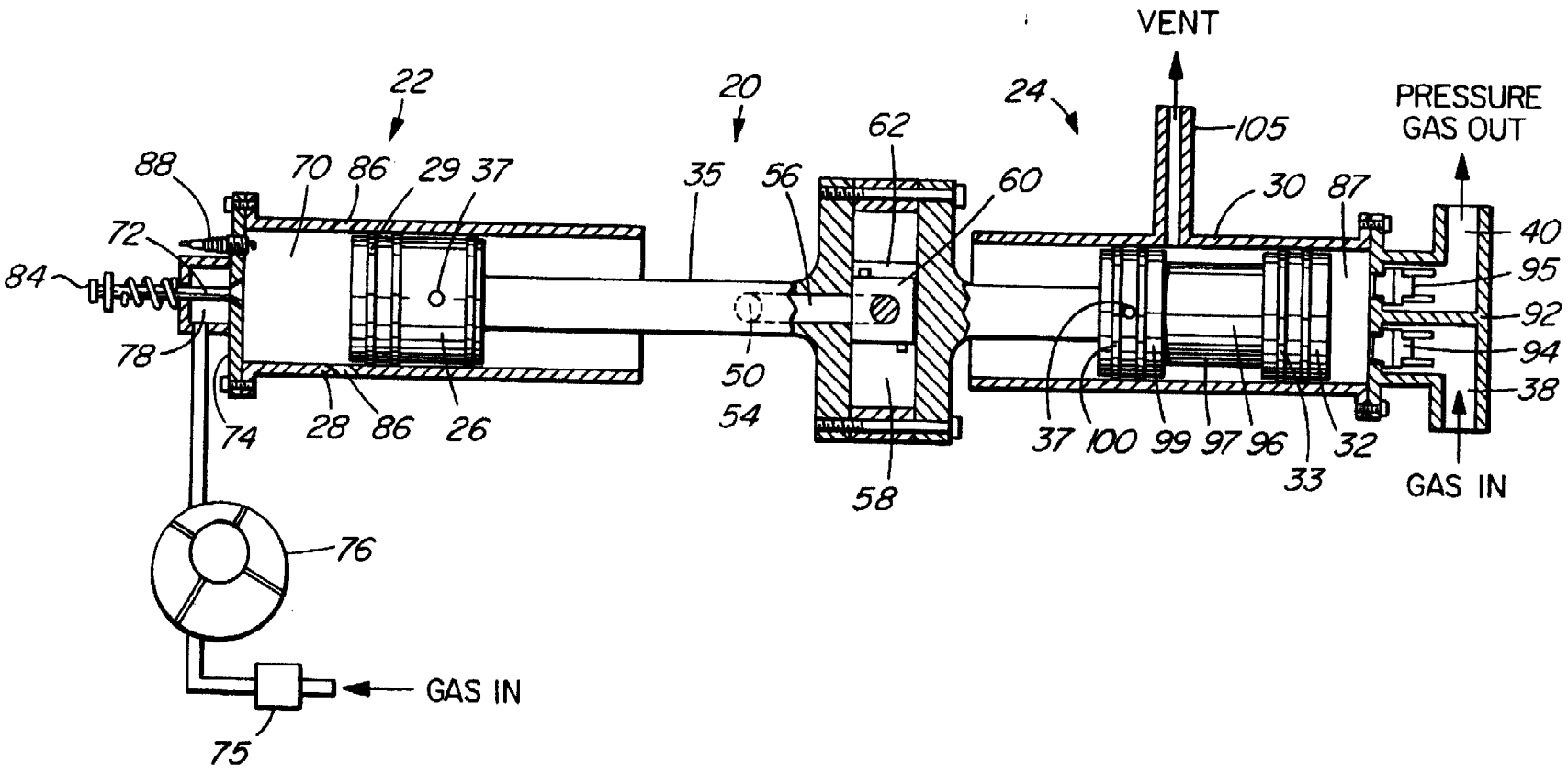
FIG. 1 is a partially schematic vertical longitudinal section through a compressor according to the invention.

As shown in FIG. 1, compressor 20 has an engine portion 22 and a compressor portion 24. Engine portion 22 directly drives compressor portion 24.

Engine portion 22 comprises an engine piston 26 slidably mounted inside an engine cylinder 28. Engine piston 26 has piston rings 29 to form a sliding seal between piston 26 and the inner wall of engine cylinder 28. Engine portion 22 preferably operates as a two-cycle internal combustion engine as described below.

Compressor portion 24 comprises a compressor piston 32 slidably mounted inside a compressor cylinder 30. Compressor piston 32 has piston rings 33 to form a sliding seal between compressor piston 32 and the inner walls of compressor cylinder 30. Where compressor 20 is oil cooled, as described below, rings 33 are preferably cast iron or another material capable of withstanding somewhat elevated temperatures. Thermoplastic piston rings of the type frequently used in water cooled natural gas compressors may deteriorate at the temperatures at which an oil cooled compressor 20 would operate.

Compressor cylinder 30 and engine cylinder 28 may both be formed by boring a hole through a single cylinder block or may be separate pieces attached together to form the block of compressor 20. Compressor cylinder 30 and engine cylinder 28 preferably comprise removable cylinder liners (not shown) which mount to the block of compressor 20. Removable cylinder liners facilitate servicing compressor 20 and also make it easy to change the diameter of compressor cylinder 30 by replacing the removable liner of compressor cylinder 30 with a removable liner having a larger or smaller bore. The preferred internal diameter of compressor cylinder 30 will depend upon the input and output pressures of the gas being compressed by compressor 20 as well as on the characteristics of engine portion 22.

Compressor cylinder 30 and engine cylinder 28 are preferably coaxial. Compressor piston 32 and engine piston 26 are linked together by a rigid control link 35. Engine piston 26 and compressor piston 32 are each preferably attached to control link 35 by means of pins 37. Engine piston 26, control link 35 and compressor piston 32 thereby reciprocate as a single reciprocating piston assembly. The reciprocation is driven by engine portion 22 and results in gas from input 38 being compressed in compressor portion 24 and expelled through output 40 as described below. Control link 35 is a substantially rigid member suited to the operating environment inside compressor 20. Control link 35 may be fabricated in several pieces, as shown in FIG. 1, for ease of manufacture and servicing.

The reciprocating motion of control link 35 is regulated by a crankshaft 50. A flywheel 51 is mounted on crankshaft 50. Flywheel 51 may be a separate piece attached to crankshaft 50 or may be a portion of crankshaft 50 which has a high moment of inertia about the axis of rotation of crankshaft 50. Crankshaft 50 is mounted to the block of compressor 20 on bearings 52 (FIG. 2) so that it can rotate freely relative to the block of compressor 20.

Crankshaft 50 is connected to reciprocating member 35 by a mechanical linkage. The mechanical linkage comprises a first arm extending between rigid link 35 and crankshaft 50 on a first side of rigid link 35 and a second arm extending between rigid link 35 and crankshaft 50 on a second side of rigid link 35. In the embodiment shown in FIG. 1, crankshaft 50 has a journal 54 extending between crank arms 56. The first and second arms of the mechanical linkage respectively comprise crank arms 56 which extend on either side of control link 35.

Journal 54 passes through and is slidable along a transversely extending aperture such as a slot 58 in control link 35. Journal 54 is rotatably mounted in a bearing block 60 which is, in turn, slidably mounted in slot 58.

Bearing block 60 preferably comprises two halves which may be separated from each other to allow disassembly of compressor 20. The portions of bearing block 60 which bear against the inner surfaces of slot 58 preferably comprise a suitable sliding material, such as pads of Babbitt metal, so that bearing block 60 can smoothly slide along slot 58.

Preferably, bearing block 60 comprises flanges 62 extending on either side of control link 35 and sliding against surfaces on control link 35 adjacent slot 58 to prevent rotation of control link 35 and pistons 26 and 32 relative to cylinders 28 and 30. In the alternative, or additionally, the control link could be prevented from turning by other means, for example, by a dowel pin engaged in a longitudinal slot or the control link could itself reciprocate in a slot in the block of compressor 20.

Engine Portion Operation

Engine portion 22 of compressor 20 is preferably a two-cycle internal combustion engine. In the exemplary embodiment shown in FIG. 1, a combustible fuel/air mixture is introduced into a combustion chamber 70 (which is defined by engine piston 26, engine cylinder 28, and a cylinder head 74) through a valve 72 mounted in cylinder head 74. Where compressor 20 is being used to compress natural gas from a gas well, the fuel is preferably natural gas. As is known in the art, the fuel is mixed with an appropriate quantity of air by a suitable fuel mixing means 75 and is then compressed by a supercharger 76 before being fed to a plenum 78 adjacent valve 72. Fuel mixing means 75 typically comprises a carburettor or a fuel injector of a suitable known type. Where a fuel injector is used fuel mixing means 75 may comprise a fuel injector valve in plenum 78 adjacent valve 72 for introducing fuel into plenum 78.

Valve 72 is operated by a linkage driven by crankshaft 50. Valve 72 could also be operated by means of a linkage connected to control link 35. In the example shown in FIGS. 1 and 2 valve 72 is operated by a cam 80 on crankshaft 50. Cam 80 pushes on a push rod 82 which, in turn, operates a rocker arm 84 to operate valve 72 in a conventional manner. Exhaust ports 86 are provided in engine cylinder 28 to exhaust gases from combustion chamber 70 at the end of each cycle.

Valve 72 preferably opens when engine piston 26 is at, or near, bottom dead center so that the incoming fuel/air mixture helps to purge combustion chamber 70 of combustion gases. After the fuel/air mixture has been introduced into combustion chamber 70 then valve 72 closes. Piston 26 then moves toward head 74 to compress the fuel air mixture in combustion chamber 70. Piston 26 is caused to move by the momentum of flywheel 51 and because the pressure inside compressor chamber 87 exceeds the pressure inside combustion chamber 70 at this point in the cycle. When piston 26 approaches its top dead center position the compressed fuel air mixture in combustion chamber 70 is ignited by suitable igniting means, such as a spark plug 88 connected to a suitable ignition system 90. The burning fuel/air mixture inside combustion chamber 70 drives piston 26 back toward its bottom dead center position, at which point the cycle repeats.

The timing of the ignition system 90 is controlled, for example, by rotation of crankshaft 50 and/or by motion of control link 35. Ignition system 90 may, for example, comprise a standard magneto ignition system driven by crankshaft 50.

Engine portion 22 preferably operates at a speed of approximately 1000 reciprocations per minute or less. Preferably compressor 20 incorporates an over-speed protection system which throttles the supply of fuel to engine portion 22 and/or cuts off ignition system 90 should engine portion 22 begin to reciprocate too quickly. Preferably the over-speed protection system should cut off fuel to engine portion 22 before cutting off ignition system 90 to avoid the possibility that unburned fuel will enter the exhaust system and cause an explosion.

Engine portion 22 could have valve 72 function as an exhaust valve in cylinder head 74 and draw in fuel through inlet ports in engine cylinder 28. This is not preferred, however, because an exhaust valve is more prone to damage due to overheating than is an inlet valve such as valve 72. Further, it may be more difficult to inject fuel using a fuel injection system where intake is through ports in engine cylinder 28.

Engine portion 22 could be a four-cycle engine, however, this would require a larger flywheel 51 to keep engine portion 22 moving on its non-power-producing stroke and would make engine portion 22 significantly more complicated. Furthermore, crankshaft 50 and the crank arms connecting crankshaft 50 to control link 35 would need to be heavier to transmit power from flywheel 51 to compressor portion 24 when engine portion 22 is not producing power.

Compressor Portion Operation

Compressor portion 24 functions as a standard reciprocating piston compressor. A compressor head 92 is mounted on the outer end of compressor cylinder 30. Compressor head 92 has an input 38 connected to a source of gas to be compressed and an output 40 for delivering compressed gas. Compressor head 92 has suitable valving, of any practical type, so that reciprocation of compressor piston 32 in compressor cylinder 30 causes gas to be drawn from input 38 into a compressor chamber 87 inside compressor cylinder 30 between compressor piston 32 and compressor head 92, compressed inside compressor chamber 87 by compressor piston 32 and expelled from output 40. In the exemplary embodiment of FIG. 1, the valving comprises a one-way input valve 94 and a one-way output valve 95. Input valve 94 and output valve 95 are preferably mounted near compressor chamber 87.

The diameter of compressor piston 32 and compressor cylinder 30 may be different from the diameters of engine cylinder 28 and engine piston 26. This may be accomplished, for example, by using differently sized removable cylinder liners, as described above.

Compressor portion 24 preferably has some particular adaptations for compressing natural gas. These adaptations may not be necessary when compressor 20 is used to compress other gases.

For compressing natural gas, compressor piston 32 preferably incorporates a moving distance piece 96. The purpose of distance piece 96 is to prevent potentially corrosive gas from leaking from compressor chamber 87 past compressor piston 32 and causing damage to other parts of compressor 20. The natural gas in some wells is highly corrosive. Furthermore, there is a risk of an explosion should the natural gas escape into a closed cavity inside compressor 20 where it might be ignited by a stray spark.

Distance piece 96, for example, comprises a section of compressor piston 32 which has been turned down to leave a vented annular cavity 97 which girdles compressor piston 32. Distance piece 96 may be any rigid member connecting a head portion of compressor piston 32 and a skirt portion 99 of compressor piston 32. Distance piece 96, and the head and skirt portions of compressor piston 32 are preferably a single unitary part but may be separate pieces connected together. Both head and skirt portions of compressor piston 32 sealingly slide in compressor cylinder 30.

The skirt portion 99 of compressor piston 32 includes a further set of piston rings 100 which slidingly seal against the walls of compressor cylinder 30 and prevent any gases from leaking past skirt portion 99 of compressor piston 32.

Annular cavity 97 is preferably somewhat longer than the stroke of compressor piston 32. A vent 105 passes through the wall of compressor cylinder 30 and vents any gases which leak past piston rings 33 into annular cavity 97 safely into the atmosphere. Vent 105 may be connected to a flare system in which vented gases are burned.

Figure 2:
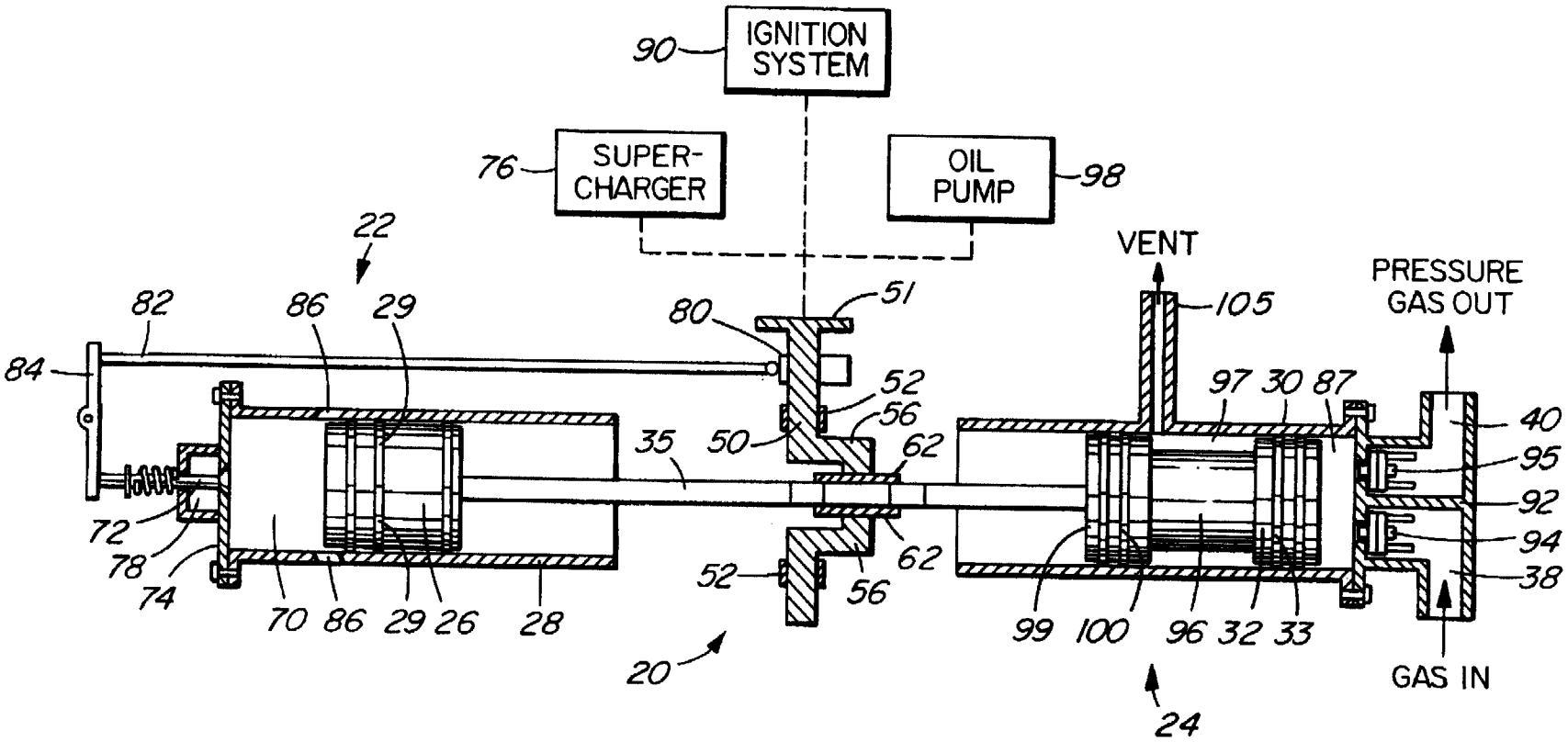
FIG. 2 is a partially schematic horizontal longitudinal section through the compressor of FIG. 1.

The construction shown in FIGS. 1 and 2 has several important advantages over prior art compressors. Firstly, crankshaft 50 merely regulates the motion of control link 35, regulates the timing of opening of valve 72 (which could be either an intake valve or an exhaust valve) and ignition system 90 and drives axillary equipment such as supercharger 76 and oil pump 98. Because crankshaft 50 does not transmit the power needed to drive compressor portion 24 then it may be lighter than the crankshaft that would be needed in a compressor of conventional design with equivalent capacity. Secondly, it can readily be appreciated that a compressor 20 according to the invention may be made with very few moving parts. Consequently, there are few parts in compressor 20 which can fail. Consequently, a compressor 20, properly manufactured, should enjoy a longer time between failures than a conventional compressor system.

The design of compressor 20 allows it to be made in a way which is very easy to service. Because compressor 20 can be made with both engine cylinder head 74 and compressor head 92 accessible, a compressor according to the invention may be readily made so that either piston can be removed and replaced with minimal effort simply by disconnecting the piston from connecting link 35, taking off the head and sliding the piston out of the cylinder. Where the pistons are connected to connecting link 35 with pins 37 then apertures may be provided to enable pins 37 to be removed without significant disassembly of compressor 20. For more extensive servicing, crankshaft 50 may be easily removed by moving control link 35 so that crank arms 56 are aligned with slot 58, dismantling bearings 52, and sliding crankshaft 50 laterally out of compressor 20. After this has been done, it is very easy to slide control link 35 to a position where it is possible to remove engine piston 26 and compressor piston 32. Piston rings 29, 33 and 100 can be easily replaced when pistons 26, 32 have been removed from their respective cylinders.

Compressor 20 includes cooling means for cooling engine cylinder 28 and compressor cylinder 30. The cooling means may, for example, comprise fins for air cooling and/or a jacket filled with water or any other suitable coolant, as is well known in the art. These features have been omitted from FIGS. 1 and 2 for clarity. Also omitted for clarity is a lubrication system which preferably includes an oil pump 98 driven by crankshaft 50 for circulating oil to lubricate bearings in compressor 20 and pistons 26 and 32. As compressor piston 32 can be lubricated from its side away from compressor chamber 87 a compressor may be made according to the invention which does not require a separate force feed lubrication system such as is used in some prior art compressors.

Figure 3A:
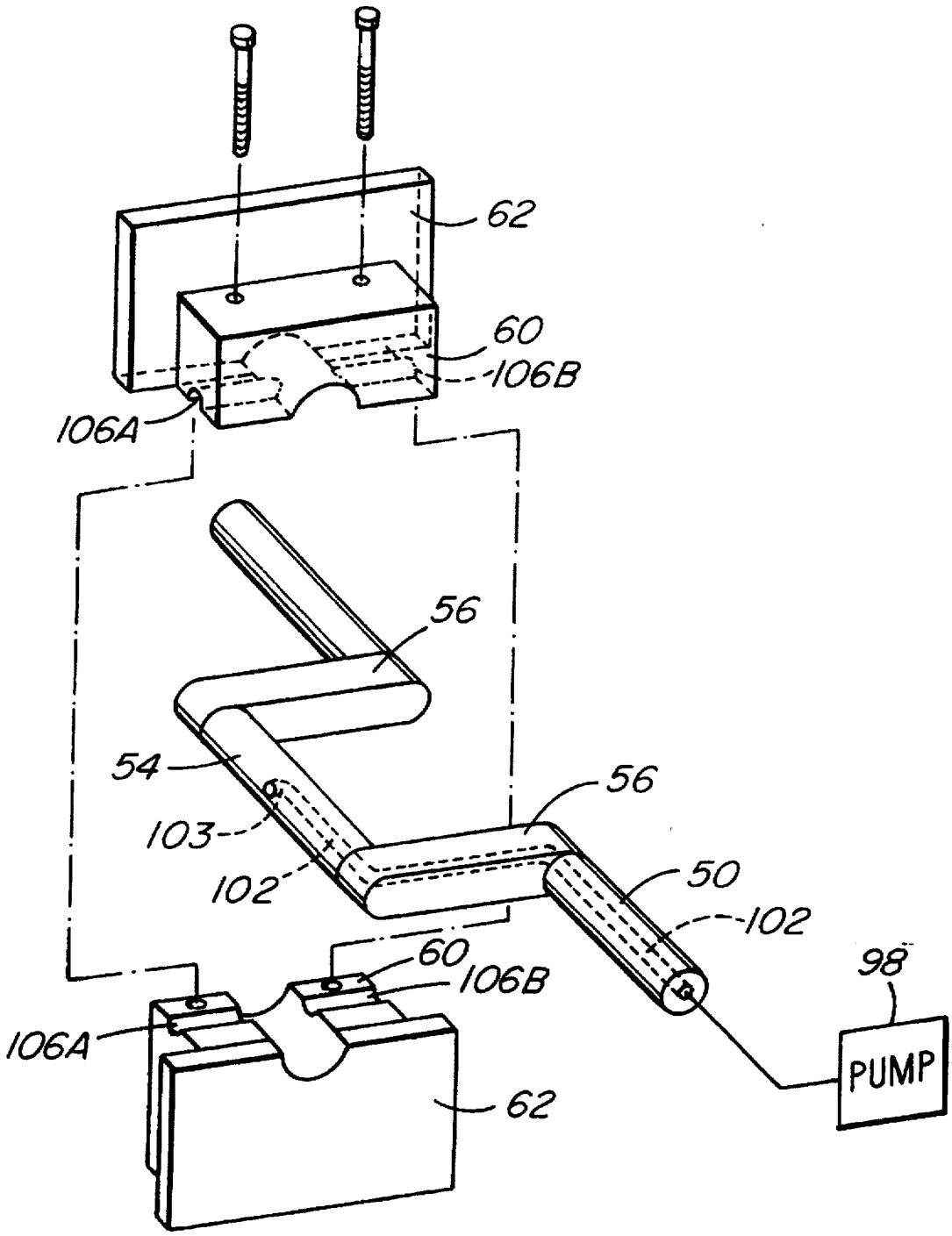
FIG. 3A is an exploded, partially schematic view of the crankshaft assembly of the compressor of FIG. 1 showing some oil passages therein.
Figure 3B:
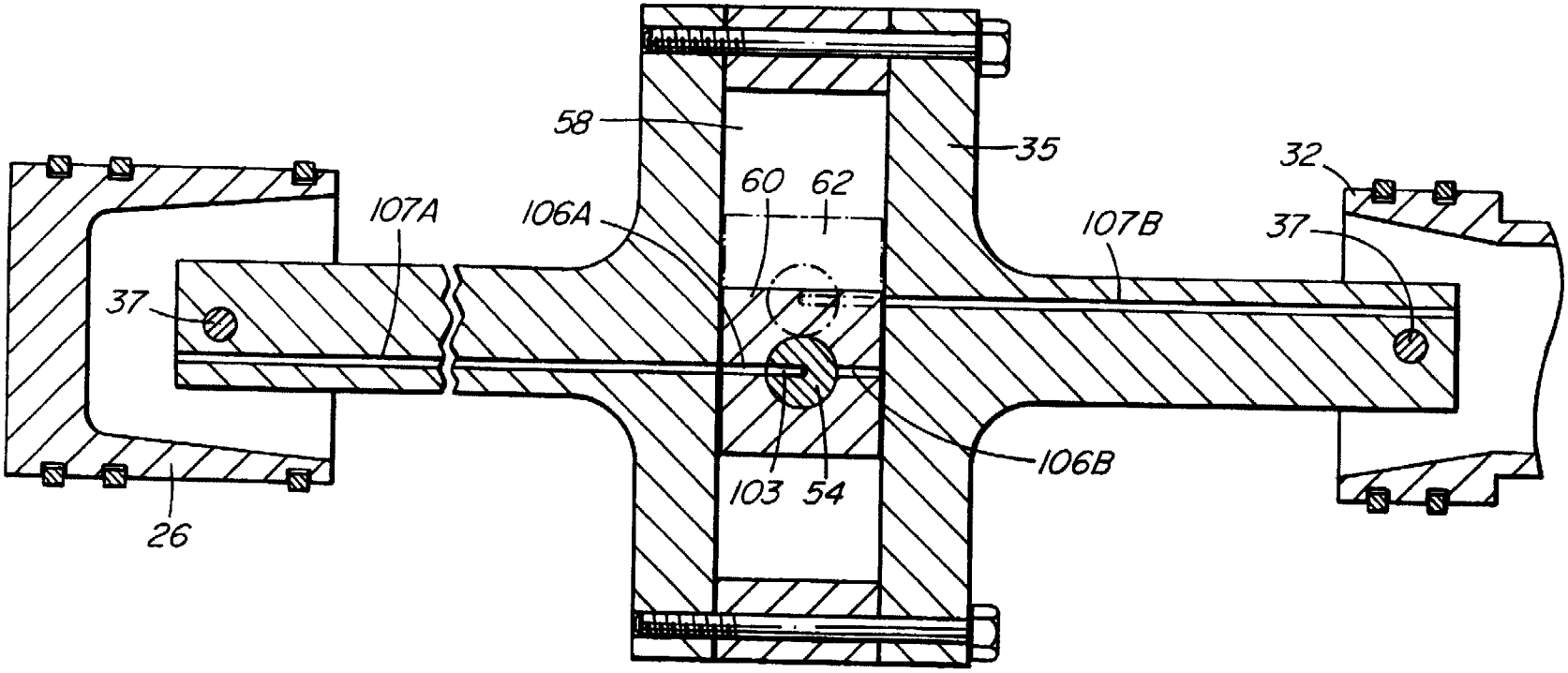
FIG. 3B is a longitudinal section through the control link and crankshaft assembly of the compressor of FIG. 1 showing some oil passages therein.

Preferably compressor 20 is oil cooled. FIGS. 3A and 3B illustrate an oil cooling system for pistons 26 and 32 which may be used with the invention. Oil is pumped by oil pump 98 into a passage 102 or gallery inside crankshaft 50. Passage 102 extends into journal 54. Longitudinal passages 103 extend from passage 102 to apertures on the portion of the surface of journal 54 inside bearing block 60. Additional oil "engine side" passages 106A, 107A extend through bearing block 60 and control link 35. When crankshaft 50 is positioned so that passages 103, 106A and 107A are aligned a squirt of oil is sprayed on the underside of engine piston 26. Additional "compressor side" passages 106B, 107B are provided to spray oil onto the underside of compressor piston 32. The oil both cools and lubricates.

Figure 4:
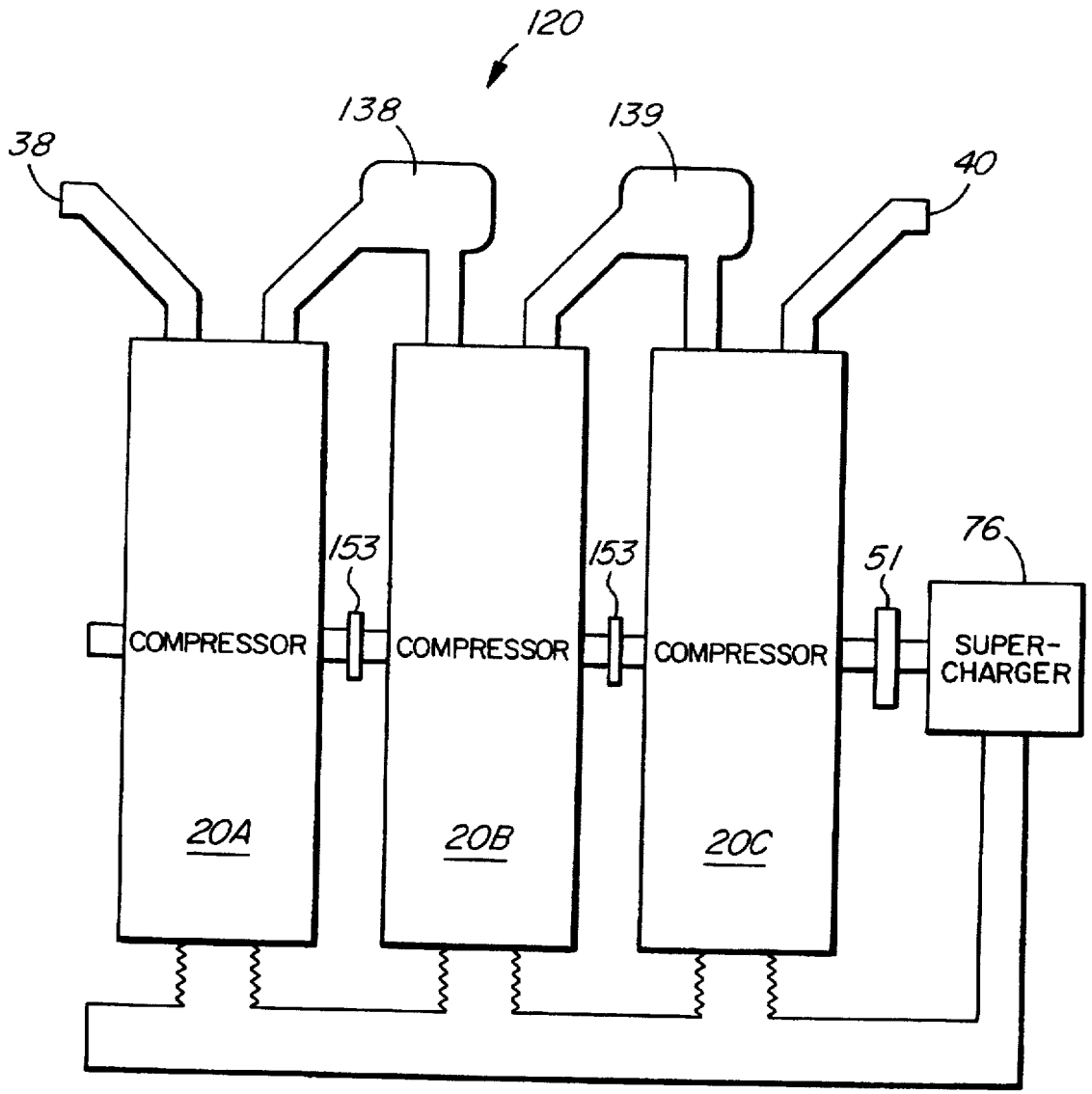
FIG. 4 is a schematic view showing three modular compressors connected in series; and, FIG. 5 is a section through a compressor according to an alternative embodiment of the invention.

One advantage of the invention is that compressors according to some embodiments of the invention can readily be made as modular units which may be mounted together to make a multi-stage compressor. For example, FIG. 4 shows a compressor 120 which comprises three compressors 20A, 20B, and 20C connected together. Compressor 20A draws in gas from input 38 and expels it into a manifold 138 at an intermediate pressure. Compressor 20 B draws in gas from manifold 138 and expels it into a second manifold 139. Compressor 20C draws in compressed gas from the second manifold 139, compresses the gas further, and delivers the further compressed gas to output 40 at a higher pressure. For example, gas may have a pressure of 10 PSi at input 38, 30

PSi in manifold 138, 90 PSi in manifold 139 and 270 PSi at output 40. Compressors 20A, 20B, and 20 C, may be balanced by adjusting their compression ratios. This may be done, for example, by providing a variable volume chamber (commonly called a "volume pocket") which is connected to compressor chamber 87, altering the compressor piston and cylinder diameters and/or by increasing the volume remaining in the compressor chamber when the piston is at top dead center by using pocketed pistons and/or by inserting spacers between compressor cylinder 30 and compressor head 92.

The crankshafts 50 of the modular compressors 20A, 20B, 20C are connected together by couplings 153 so that modular compressors 20A, 20B, 20C operate together. The relative timing of the cycles of compressors 20A, 20B, 20C is therefore preserved. A single flywheel 51 may be mounted on any one of crankshafts 50. A single supercharger 76 may serve all of compressors 20A, 20B, 20C in compressor 120.

An advantage of the modular construction of FIG. 4 is that it is easy to adjust compressor 120 to suit changing conditions in a gas well or at a gas plant. Initially, when a well is young, the pressure in input 38 may be sufficient that only a single compressor 20A is needed. As gas is drawn from the well, and the pressure in input 38 drops, additional compressors 20B, 20C may be added in series with compressor 20A, as needed to maintain the pressure at output 40 at an acceptable level. This can be much more straightforward than bringing a completely new compressor to the well. Additional compressors 20B and 20C are relatively small and light.

While engine cylinder 28 and compressor cylinder 30 are preferably coaxial, in some applications it may be desirable for compressor portion 24 to comprise two or more separate parallel compressor cylinders and/or for engine portion 22 to comprise two or more separate parallel engine cylinders. In such applications, control link 35 is connected to each of the engine pistons and each of the compressor pistons. Where this is done, compressor cylinders are not necessarily coaxial with engine cylinder 28 however, all of the compressor cylinders should be generally parallel to the engine cylinder (or engine cylinders) and should be positioned so that the forces acting on control link 35 do not cause control link 35 to yaw from side to side as it reciprocates.

An Alternative Embodiment of the Invention

Figure 5:
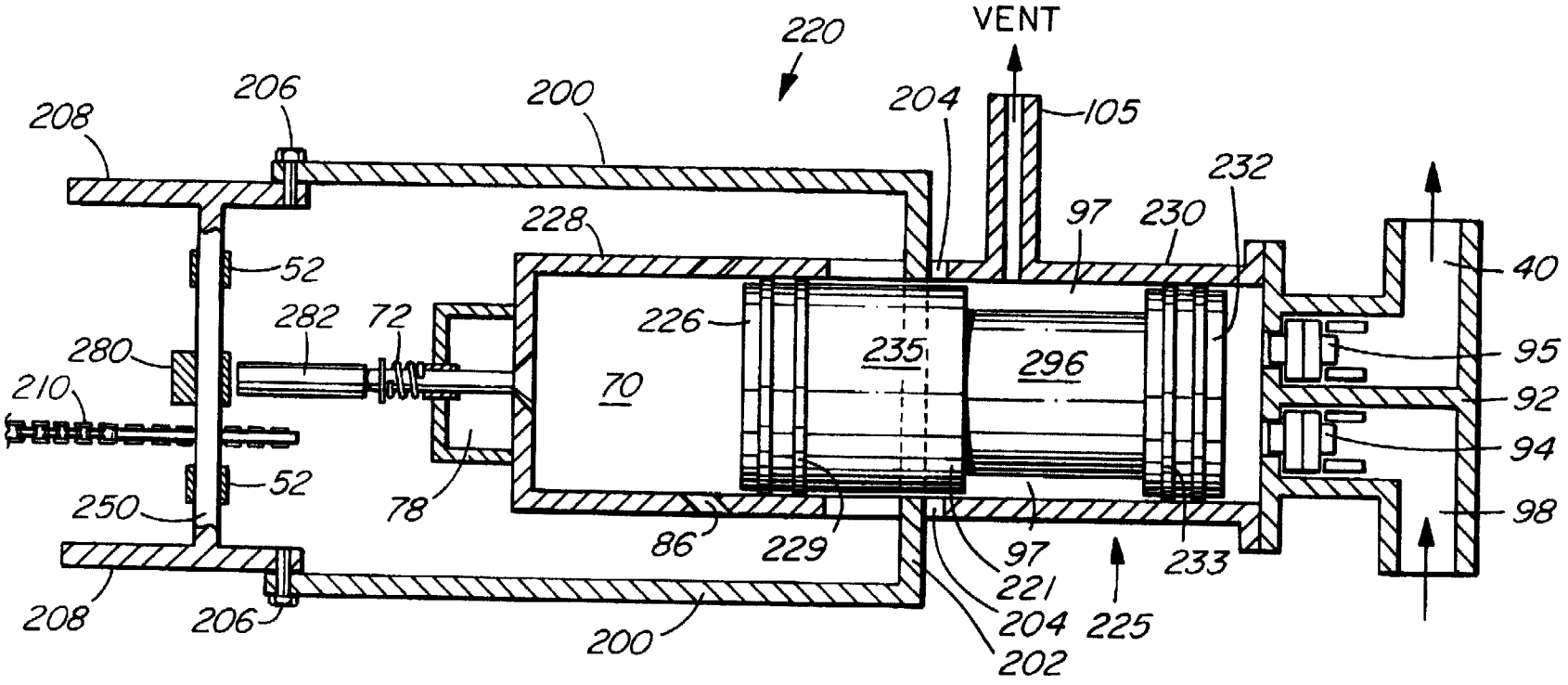

FIG. 5 shows a compressor 220 according to an alternative embodiment of the invention. Compressor 220 operates in substantially the same manner as the compressor 20 described above.

Compressor 220 has a unitary reciprocating piston 221. Piston 221 has an engine end 226 equipped with piston rings 229, a compressor end 232 equipped with piston rings 233 a control link portion 235 which serves substantially the same function as control link 35 and a turned down distance piece portion 296 which serves substantially the same function as distance piece 96 of the embodiment shown in FIGS. 1 and 2. Piston 221 slides in a single cylinder 225 which has an engine end 228 and a compressor end 230. If necessary for a particular application, a sleeve may be placed inside cylinder 225 and compressor end 232 of piston 221 may be turned down to fit inside the sleeve.

The motion of piston 221 is regulated by a crankshaft 250. Piston 221 is connected to crankshaft 250 by means of a pair of connecting rods 200. Connecting rods 200 extend on either side of control link portion 235 of piston 221 between journals 206 on crankshaft 250 and respective ends of a transverse pin 202 which projects from piston 221 through slots 204 in cylinder 230. Pin 202 can slide freely longitudinally along slots 204.

Journal 206 may be mounted on crank arms or, may be mounted on flywheels 208 as shown. Ancillary equipment such as a supercharger and a magneto may be driven by means of a mechanical drive, such as a chain or gear drive 210, from crankshaft 250. Valve 72 may be operated by means of a straight push rod 282 actuated by cam 280 on crankshaft 250.

It can be appreciated that in both exemplary embodiments of the invention described herein the linkage between the reciprocating piston assembly (comprising pistons 26 and 32 and control link 35 in the embodiment of FIGS. 1 and 2 and comprising piston 221 in the embodiment of FIG. 5) and the crankshaft is such that, when the piston assembly is near either end of its stroke, the forces between the piston assembly and the linkage are directed generally along the longitudinal centerline of the piston assembly. The tendency for the piston assembly to yaw from side to side in the plane of the crankshaft and cylinders is reduced because, in both cases, the linkage comprises arms (crank arms 56 in the case of the embodiment of FIGS. 1 and 2 and connecting rods 200 in the case of the embodiment of FIG. 5) which extend on either side of the piston assembly.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A gas compressor comprising:

(a) an engine cylinder (28) having a longitudinal axis;

(b) an engine piston (26) slidably and sealingly mounted in said engine cylinder (28);

(c) a compressor cylinder (30) coaxial with said engine cylinder (28);

(d) a compressor piston (32) slidably and sealingly mounted in said compressor cylinder (30);

(e) a rigid link (35) connecting said engine piston (26) and said compressor piston (32); and (f) a crankshaft (50) having a journal (54) extending through, and slidable along, a transversely extending aperture (58) in said rigid link (35)

wherein said compressor piston comprises head and skirt portions each sealingly slidable in said compressor cylinder and a rigid distance piece connecting said head and skirt portions and wherein a cavity between said distance piece and an inner wall of said compressor cylinder is vented.

2. A gas compressor comprising:

(a) an engine cylinder having a longitudinal axis;

(b) an engine piston slidably and sealingly mounted in said engine cylinder;

(c) a compressor cylinder coaxial with said engine cylinder;

(d) a compressor piston slidably and sealingly mounted in said compressor cylinder;

(e) a rigid link connecting said engine piston and said compressor piston; and (f) a crankshaft having a journal extending through, and slidable along, a transversely extending aperture comprising a parallel-sided slot in said rigid link wherein said journal is journalled for rotation in a bearing block and said bearing block is slidably mounted in said transversely extending aperture in said rigid link and said compressor piston comprises head and skirt portions each sealingly slidable in said compressor cylinder and a rigid distance piece connecting said head and skirt portions and wherein a cavity between said distance piece and an inner wall of said compressor cylinder is vented.

3. The gas compressor of claim 2 wherein said bearing block comprises a flange bearing against a surface on said rigid link adjacent said slot.

4. The gas compressor of claim 2 wherein said rigid link comprises an engine side oil passage, said engine side oil passage having an outlet facing said engine piston and said gas compressor comprises means for forcing oil through said engine side oil passage and onto said engine piston to cool said engine piston.

5. The gas compressor of claim 2 wherein said rigid link comprises a compressor side oil passage, said compressor side oil passage having an outlet facing said compressor piston and said gas compressor comprises means for forcing oil through said compressor side oil passage and onto said compressor piston to cool said compressor piston.

6. The gas compressor of claim 5 wherein said rigid link comprises an engine side oil passage, said engine side oil passage having an outlet facing said engine piston and said gas compressor comprises means for forcing oil through said engine side oil passage and onto said engine piston to cool said engine piston.

7. The gas compressor of claim 6 wherein said engine side oil passage and said compressor side oil passage extend to said slot and said means for forcing oil comprises an oil pump connected to a gallery within said journal and said gallery is in fluid communication with said engine side oil passage for at least some positions of said bearing block and said gallery is in fluid communication with said compressor side oil passage for at least some positions of said bearing block.

8. The gas compressor of claim 2 wherein said engine cylinder comprises a wall having an exhaust port extending therethrough.

* * * * *